US011385584B2

(12) United States Patent
Takayama et al.

(10) Patent No.: US 11,385,584 B2
(45) Date of Patent: Jul. 12, 2022

(54) IMAGE FORMING APPARATUS

(71) Applicant: CANON KABUSHIKI KAISHA, Tokyo (JP)

(72) Inventors: Toshihiko Takayama, Kanagawa (JP); Takeshi Shinji, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/348,998

(22) Filed: Jun. 16, 2021

(65) Prior Publication Data

US 2021/0405567 A1 Dec. 30, 2021

(30) Foreign Application Priority Data

Jun. 24, 2020 (JP) ..... JP2020-108953

(51) Int. Cl.
*G03G 15/00* (2006.01)
*G03G 15/20* (2006.01)

(52) U.S. Cl.
CPC ..... *G03G 15/5029* (2013.01); *G03G 15/2064* (2013.01); *G03G 15/6561* (2013.01); *G03G 15/6567* (2013.01)

(58) Field of Classification Search
CPC ..... G03G 15/5029; G03G 15/6561; G03G 15/6567; G03G 15/6564
See application file for complete search history.

(56) References Cited

U.S. PATENT DOCUMENTS

2021/0387823 A1* 12/2021 Nishii ..... B65H 3/0669

FOREIGN PATENT DOCUMENTS

| | | | | |
|---|---|---|---|---|
| JP | H04-204980 A | | 7/1992 | |
| JP | H10-20718 A | | 1/1998 | |
| JP | 2001-209291 A | | 8/2001 | |
| JP | 2002296933 A | * | 10/2002 | |
| JP | 2014-071185 A | | 4/2014 | |
| JP | 2021043245 A | * | 3/2021 | ..... G03G 15/2021 |

* cited by examiner

*Primary Examiner* — Sevan A Aydin
(74) *Attorney, Agent, or Firm* — Venable LLP

(57) ABSTRACT

An image forming apparatus includes a control unit configured to perform a first mode, a second mode, and a third mode. The first mode is a mode in which a sheet conveyance unit is controlled so that an arrival time from a passage of a trailing edge of a preceding sheet through a nip portion to an arrival of a leading edge of a succeeding sheet succeeding to the preceding sheet at the nip portion becomes a first time. The second mode is a mode in which the sheet conveyance unit is controlled so that the arrival time becomes a second time. The third mode is a mode in which the sheet conveyance unit is controlled so that the arrival time becomes a third time. The second time is longer than the first time, and the third time is longer than the second time.

8 Claims, 10 Drawing Sheets

IMAGE FORMING APPARATUS

BACKGROUND OF THE INVENTION

Field of the Invention

This invention relates to an image forming apparatus forming an image on a sheet.

Description of the Related Art

In an image forming apparatus such as a printer and a copier, there is an apparatus which forms an image on a sheet by an electrophotographic system. In the electrophotographic system, after a toner image has been transferred to the sheet, the toner image is fixed on the sheet by being conveyed to a fixing unit which heats and presses the sheet. In a case where a narrow sheet width sheet is continuously conveyed to the fixing unit, because of heat transmission to the sheet, a so-called sheet non-passing portion temperature rise by which a temperature rise at a sheet non-passing portion becomes larger than the temperature rise at a sheet passing portion occurs at a fixing nip portion at which the sheet is heated and pressed.

The sheet non-passing portion temperature rise at the fixing nip portion causes unevenness in a film feed speed in a fixing unit of a film heating method described in Japanese Patent Laid-Open H04-204980. Further, since the sheet non-passing portion temperature rise also causes ununiform expansion of a pressing roller of the fixing unit, there is a problem of degradation of a printing quality, such as occurrence of wrinkles of the sheet and defective fixing of the toner, which needs to be tackled.

Hitherto, when the narrow sheet width sheet is conveyed to the fixing nip portion, as a countermeasure to the sheet non-passing portion temperature rise, control by which a sheet feed interval is widened so as to decrease temperature at the nip portion by extending a time during which the sheet does not exist at the nip portion is performed. However, depending on a configuration of the apparatus, sometimes, it is possible to judge the sheet width only in two sizes of a normal size and a small size. In this case, when it is judged as the small size, the sheet feed interval is set by assuming the minimum width sheet usable for the apparatus so as to prevent the degradation of the printing quality due to the sheet non-passing portion temperature rise.

Accordingly, in a case where the sheet width of the sheet actually used is small but relatively large, the sheet feed interval is unnecessarily widened so that productivity of printing is decreased.

SUMMARY OF THE INVENTION

According to one aspect of the present invention, an image forming apparatus includes an image forming unit configured to form a toner image on a sheet, a sheet conveyance unit configured to convey the sheet toward the image forming unit in a sheet conveyance direction, a fixing unit including a rotary member pair configured to form a nip portion and a heating element configured to heat the nip portion, the fixing unit being configured to fix the toner image on the sheet by heating the sheet on which the toner image is formed at the nip portion, a sheet width detection unit configured to output a first signal and a second signal, the sheet width detection unit being configured to output the first signal in a case where a sheet length in a width direction orthogonal to the sheet conveyance direction is equal to or larger than a first threshold value, the sheet width detection unit being configured to output the second signal in a case where the sheet length in the width direction is less than the first threshold value, a sheet length detection unit configured to output an output value corresponding to a sheet length in the sheet conveyance direction, and a control unit configured to perform a first mode, a second mode, and a third mode in a job continuously conveying a plurality of sheets, the first mode being a mode in which the sheet conveyance unit is controlled so that an arrival time from a passage of a trailing edge of a preceding sheet through the nip portion to an arrival of a leading edge of a succeeding sheet succeeding to the preceding sheet at the nip portion becomes a first time, the second mode being a mode in which the sheet conveyance unit is controlled so that the arrival time becomes a second time, the third mode being a mode in which the sheet conveyance unit is controlled so that the arrival time becomes a third time, the second time being longer than the first time, the third time being longer than the second time. The control unit is configured to perform the first mode in a case where the sheet width detection unit outputs the first signal, and configured to perform the third mode in a case where the sheet width detection unit outputs the second signal and the sheet length detection unit outputs the output value not corresponding to a length, in the sheet conveyance direction, of a sheet size information specified by the job, and configured to perform the second mode in a case where the sheet width detection unit outputs the second signal and the sheet length detection unit outputs the output value corresponding to the length, in the sheet conveyance direction, of the sheet size information.

Further features of the present invention will become apparent from the following description of exemplary embodiments with reference to the attached drawings.

DESCRIPTION OF THE EMBODIMENTS

Hereinafter, exemplary embodiments of this disclosure will be described with reference to attached drawings.

First Embodiment

General Arrangement of Image Forming Apparatus

Figure 1:
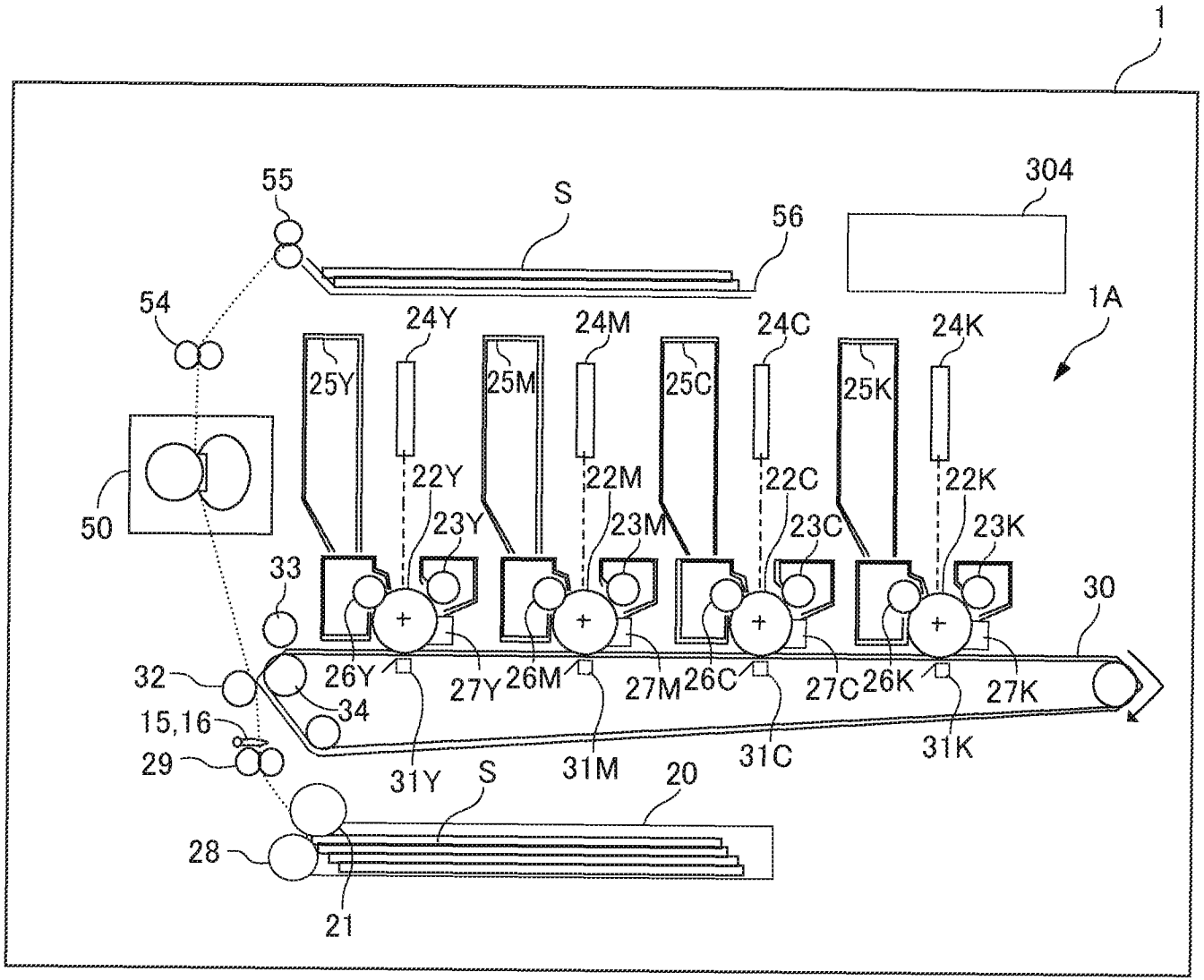
FIG. 1 is a schematic view of a configuration of a printer according to a first embodiment.

At first, with reference to FIG. 1, a configuration of a printer 1, serving as an image forming apparatus in this embodiment, will be described. FIG. 1 is a schematic configuration diagram of the printer 1. The printer 1 includes a feed cassette 20, an image forming engine 1A of an electrophotographic system, a charge unit 33 for a remaining toner, a fixing unit 50, and a control unit 304. Based on an image forming job which is input from a connected external apparatus, an operation part, not shown, and the like, the printer 1 performs a printing process by forming toner images of yellow (Y), magenta (M), cyan (C), and black (K), and fixing the toner image on a sheet S. The image forming engine 1A, serving as an image forming unit in this embodiment, includes photosensitive member drums 22Y, 22M, 22C, and 22K, charge units 23Y, 23M, 23C, and 23K, and toner cartridges 25Y, 25M, 25C, and 25K. Further, the image forming engine 1A also includes developing units 26Y, 26M, 26C, and 26K, an intermediate transfer member 30, primary transfer units 31Y, 31M, 31C, and 31K, and a secondary transfer roller 32. To be noted, in the following descriptions, an operation to form the toner image of yellow (Y) will be described as an example, and, regarding the toner images of the other colors, duplicating descriptions will be omitted herein.

The photosensitive member drum 22Y, whose outer peripheral surface of an aluminum cylinder is coated with an organic photo conductive layer, is rotatably driven counter-clockwise by a driving force of a drive motor, not shown. The charge unit 23Y uniformly charges the surface of photosensitive member drum 22Y. Based on the job, the control unit 304 controls a laser scanner 24Y so that the surface of photosensitive member drum 22Y is selectively exposed with an irradiated laser beam. Herewith, an electrostatic latent image to form an image based on the job is formed on the surface of photosensitive member drum 22Y. The electrostatic latent image formed on the photosensitive member drum 22Y is developed as the toner image of yellow by the developing unit 26Y. To be noted, the developing units 26Y, 26M, 26C, and 26K are respectively capable of coming into contact with and being separated from the photosensitive member drums 22Y, 22M, 22C, and 22K by a contact/separation mechanism, not shown.

The intermediate transfer member 30 is an endless belt made of resin, and disposed in a state being in contact with the photosensitive member drums 22Y, 22M, 22C, and 22K. The intermediate transfer member 30 is rotatably driven clockwise by a driving force of a drive motor, not shown, along with rotation of the photosensitive member drums 22Y, 22M, 22C, and 22K. The toner image of yellow on the surface of the photosensitive member drum 22Y is transferred to the intermediate transfer member 30 by being applied with a voltage by the primary transfer unit 31Y. By a series of the processes as described above, the toner images of Y, M, C, and K are transferred to the intermediate transfer member 30 in sequence (primary transfer). Toners remaining on the photosensitive member drums 22Y, 22M, 22C, and 22K are respectively collected by cleaning units 27Y, 27M, 27C, and 27K.

The sheet S stacked on the feed cassette 20 is fed to the image forming engine 1A by a feed roller 21 and a retard roller 28, constituting a sheet feed unit. The sheet feed unit of this embodiment is constituted by the feed cassette 20, the feed roller 21, and the retard roller 28. The sheet fed from the feed cassette 20 is conveyed by a registration roller pair 29 to a transfer nip portion formed by the secondary transfer roller 32 and an inner roller 34 in a timing synchronizing with the image formation at the image forming engine 1A. The registration roller pair 29 is freely rotatably disposed between the feed roller 21 and the image forming engine 1A with respect to a sheet conveyance direction. Further, the registration roller pair 29 is capable of correcting a skew of the sheet S by bringing the sheet S into contact with a nip portion of the registration roller pair 29 with the registration roller pair 29 stopping rotation. The control unit 304 judges a size of the sheet S based on detection results of a sheet length sensor 15 and a sheet width sensor 16 disposed downstream of the registration roller pair 29 in the sheet conveyance direction. A sheet length detection unit of this embodiment is the sheet length sensor 15, and a sheet width detection unit is the sheet width sensor 16. Thereafter, in a state where the sheet S is nipped by the secondary transfer roller 32 and the intermediate transfer member 30 which is brought into pressure contact with the secondary transfer roller 32 by the inner roller 34, the voltage is applied to the secondary transfer roller 32, and the toner image on the intermediate transfer member 30 is transferred to the sheet S (secondary transfer). The sheet S on which the toner image has been transferred is conveyed to the fixing unit 50. To be noted, the charge unit 33 is for charging the toner remained on the intermediate transfer member 30 after the secondary transfer. The toner remained on the intermediate transfer member 30 is charged in the reverse of an original polarity by the charge unit 33, collected electrostatically by the primary transfer unit 31 on the photosensitive member drum 22, and finally removed by the cleaning unit 27.

The fixing unit 50, serving as a fixing unit of this embodiment, fixes the toner on the sheet S by pressing and heating the sheet S, and a detail configuration will be described later. The sheet S with the toner fixed is discharged to a sheet discharge tray 56 by sheet discharge rollers 54 and 55, and the printing operation ends. In this embodiment, a sheet conveyance unit conveying the sheet is constituted by the feed roller 21, the retard roller 28, the registration roller pair 29, the secondary transfer roller 32, the intermediate transfer member 30, and the sheet discharge rollers 54 and 55. To be noted, in this embodiment, a process speed at the image forming engine 1A is set at 132 mm/second, and a sheet feed interval from the feed cassette 20 is set at 24 ppm (pages per minute) in a case longitudinally feeding an A4 size.

Control Configuration of Image Forming Apparatus

Figure 2:
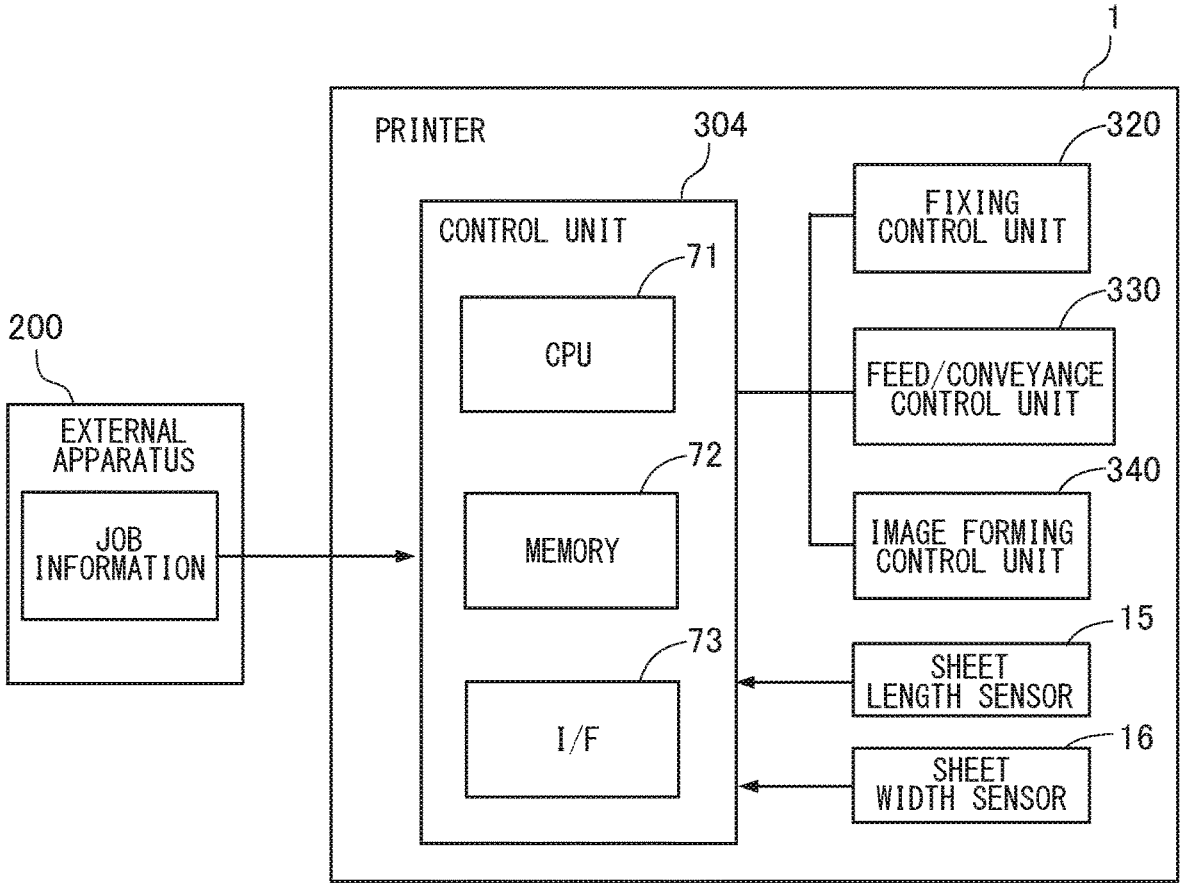
FIG. 2 is a block diagram of a control configuration of the printer according to the first embodiment.

Next, with reference to FIG. 2, a control configuration of the printer 1 will be described. FIG. 2 is a function block diagram showing a configuration of the control unit 304 performing control of the printer 1. The control unit 304 is constituted by including a CPU (central processing unit) 71, serving as a calculation unit, a memory 72, serving as a memory unit, including a ROM (read only memory) and a RAM (random access memory), an I/F (interface) 73 controlling communication with an external apparatus, and the like. The RAM stores information input to the control unit 304, detected information, a calculation result of the CPU 71, and the like. The ROM stores a control program of the printer 1, a data table, and the like. It is possible to reciprocally transmit and read in data between the CPU 71 and the memory 72, and the memory 72 is used as a work area when the CPU 71 performs a calculation.

Each unit of a mechanism which forms the image on the sheet by the image forming process described in FIG. 1 is coupled to the control unit 304. For example, a fixing control unit 320 performs temperature control and the like of the fixing unit 50. Further, a feed/conveyance control unit 330 performs feed interval control of the sheet from the feed cassette 20, and an image forming control unit 340 controls the process speed and the operations such as the developing, charging, and transferring. Further, an external apparatus 200, such as a personal computer, communicably coupled to the printer 1 is coupled to the control unit 304.

Job information (including such as a print start command, print mode information such as monochrome and color, setting information such as sheet size information, an image signal of a print object) is input to the control unit 304. The control unit 304 controls to bring each unit of the printer 1 to execute an image forming operation forming the toner image on the sheet. To be noted, it is possible for a user to input the setting information and the print start command from a setting screen 210 (refer to FIG. 3) displayed on a display part 200A of the external apparatus 200 by a printer driver mounted in the external apparatus 200, a setting screen displayed in an operation part, not shown, and the like. The job information transmitted to the printer 1 is input to the CPU 71 via the I/F 73 in the control unit 304.

Figure 3A:
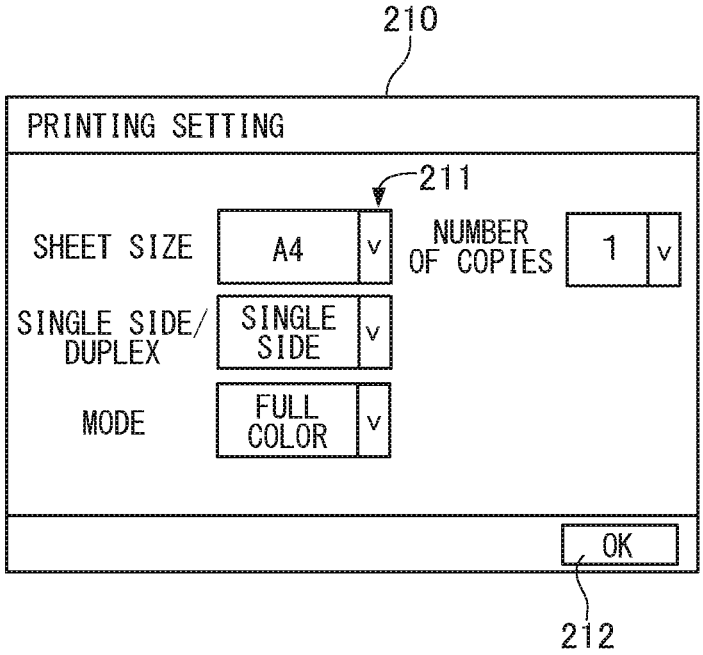
FIGS. 3A and 3B are drawings showing a configuration of a setting screen according to the first embodiment.
Figure 3B:
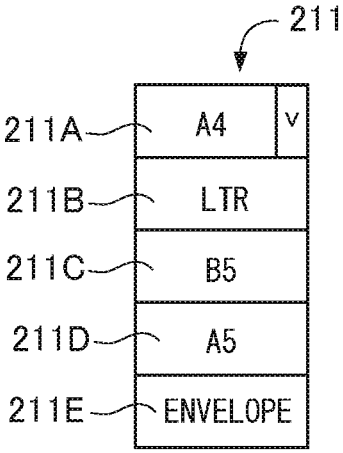

In this embodiment, a size selection button 211 is disposed in the setting screen 210. FIGS. 3A and 3B indicate an example of a configuration of the setting screen 210. To be noted, the setting screen 210 is a screen displayed in the external apparatus 200, the operation part, not shown, and the like. When the size selection button 211 shown in FIG. 3A is selected, a pull-down menu as shown in FIG. 3B is displayed. The pull-down menu includes buttons, such as the A4 size 211A, a LTR (letter) size 211B, a B5 size 211C, and an A5 size 211D, to select the sheet size. When any of the sheet size (for example, the A4 size 211A) is selected from the pull-down menu and an OK button 212 (refer to FIG. 3A) is tapped, it is reflected to the sheet size information that the sheet size of the sheet used for the printing is the A4 size. Then, when an operation to execute the print start command is performed, the job information including the sheet size information which indicates the sheet used for the printing is the A4 size is input to the control unit 304. Herewith, the control unit 304 starts execution of the image forming operation based on the job information.

Aspect of Detection of Sheet Size

Figure 4:
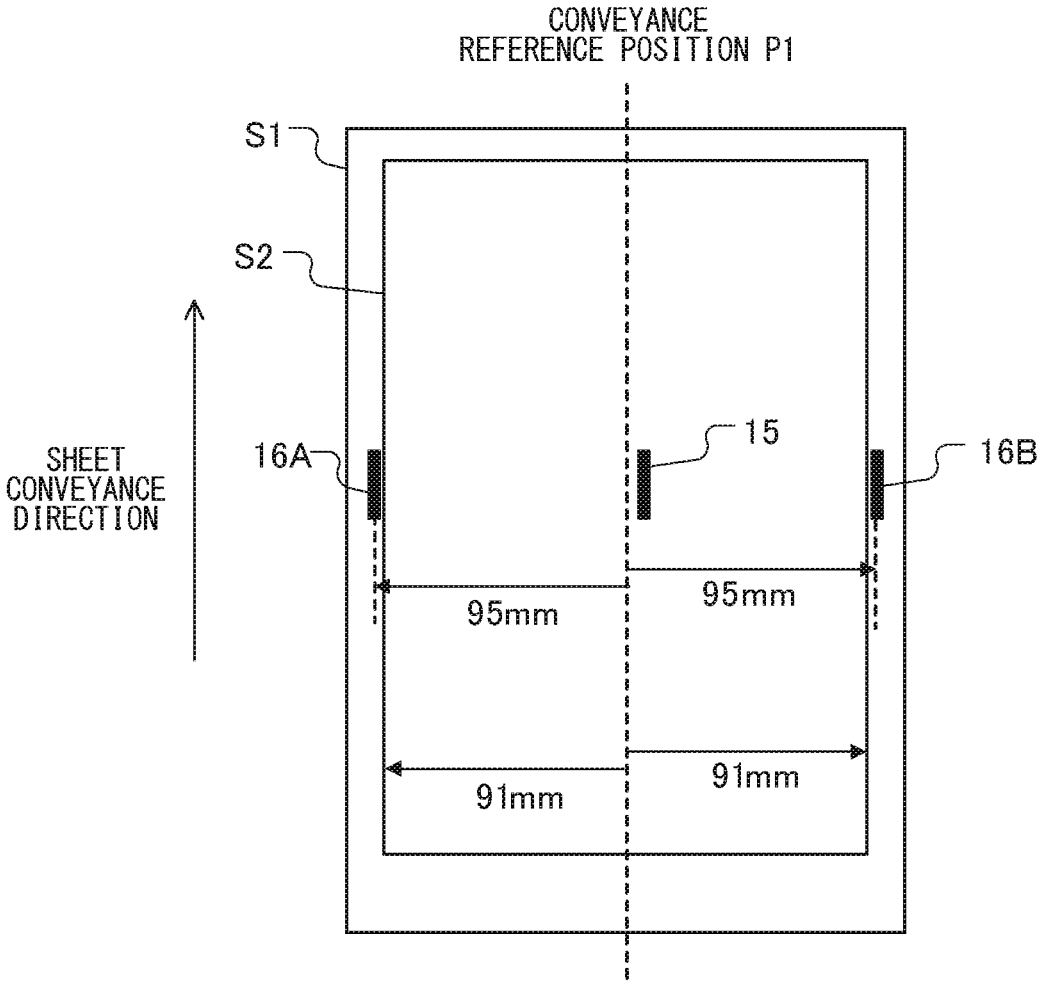
FIG. 4 is a drawing illustrating an aspect of detection of a sheet size according to the first embodiment.

Next, with reference to FIG. 4, an aspect of detection of the sheet size in this embodiment will be described. FIG. 4 is a diagram exemplifying arrangement positions of the sheet length sensor 15 and the sheet width sensor 16. As shown in FIG. 4, in this embodiment, sheet width sensors 16A and 16B are disposed on both sides of the sheet across a conveyance reference position P1, and the sheet length sensor 15 is disposed at a position closer to the conveyance reference position P1 than the sheet width sensor 16B. Since configurations of the sheet width sensors 16A and 16B are common, in the following descriptions, both of the sheet width sensors 16A and 16B are mentioned as the sheet width sensor 16 when it is not necessary to distinguish from each other. In this embodiment, the sheet length sensor 15 and the sheet width sensor 16 are configured to include a lever member which is brought down when an edge of the sheet comes into contact, and ON and OFF signals are respectively output in a brought down state and not in the brought down state of the lever member.

At first, the aspect of the detection of a sheet length in the sheet conveyance direction by the sheet length sensor 15 will be described. When the job is started at the printer 1, the sheet is fed from the feed cassette 20. A conveyance speed of the sheet S is adjusted to synchronize with a timing of the image formation at the image forming engine 1A by controlling, for example, the feed interval from the feed cassette 20 and the like. The lever member disposed at a detection position of the sheet length sensor 15 which is disposed downstream of the registration roller pair 29 in the sheet conveyance direction is brought down by a leading edge of the sheet S. Thereafter, the sheet length sensor 15 outputs the ON signal during a time until a trailing edge of the sheet S has passed through the detection position of the sheet length sensor 15. Accordingly, in a case where the conveyance speed of the sheet S is kept constant, the sheet length sensor 15 outputs an output value corresponding to the length of the sheet S in the conveyance direction. The output value of the sheet length sensor 15 is input to the control unit 304. The control unit 304 obtains the length of the sheet S in the sheet conveyance direction from duration of the ON signal of the sheet length sensor 15 and the conveyance speed of the sheet S (for example, the process speed at the image forming engine 1A). Sheet throughput is maintained by starting a feed of a succeeding sheet in a timing when a predetermined time has passed after the leading edge or trailing edge of the proceeding sheet antecedently fed from the feed cassette 20 passed through the sheet length sensor 15. Further, it is acceptable that the control unit 304 starts the feed of the succeeding sheet succeeding to the proceeding sheet fed from the feed cassette 20 corresponding to the length of the sheet S in the sheet conveyance direction. As described above, it is possible to perform a feedback control of an arrival time from when the trailing edge of the preceding sheet has passed through the nip portion N (refer to FIG. 5) of the fixing unit 50 until when the leading edge of the succeeding sheet arrives at the nip portion N. Further, since the sheet length sensor 15 is disposed at the position closer to the conveyance reference position P1 than the sheet width sensor 16B in a width direction, it is possible to accurately detect the length of the sheet S in the sheet conveyance direction also in a case of a narrow width sheet.

Next, a length of the sheet in the width direction orthogonally intersecting with the sheet conveyance direction will be described. The lever members disposed at detection positions of the sheet width sensors 16A and 16B disposed downstream of the registration roller pair 29 in the sheet conveyance direction are brought down by the leading edge of the sheet S. As shown in FIG. 4, each of the sheet width sensors 16A and 16B is disposed with a distance of 95 mm from the conveyance reference position P1 in the width direction. That is, a distance between the sheet width sensors 16A and 16B in the width direction is 190 mm. At this point, it is assumed that the sheet S is conveyed in a manner that a center of the sheet S in the width direction is along the conveyance reference position P1. In a case of a sheet S1 whose length in the width direction is the A4 size (210 mm), the lever members disposed at the detection positions of the sheet width sensors 16A and 16B are brought down. On the other hand, in a case of a sheet S2 whose length in the width direction is the B5 size (182 mm), since the sheet does not pass the detection positions of the sheet width sensors 16A and 16B, the lever members of the sheet width sensors 16A and 16B are not brought down. That is, the sheet width sensor 16 outputs the ON signal, which is a first signal, in a case where the sheet length in the width direction is equal to or larger than the distance between the sheet width sensors 16A and 16B. On the other hand, the sheet width sensor 16 outputs the OFF signal, which is a second signal, in a case where the sheet length in the width direction is less than the distance between the sheet width sensors 16A and 16B. A first threshold value of this embodiment is the distance between the sheet width sensors 16A and 16B in the width direction. As described above, the sheet width sensor 16 outputs the signal depending on whether the sheet length in the width direction is equal to or larger than the distance between the sheet width sensors 16A and 16B, that is, equal to or larger than the first threshold value, or less than the distance, that is, less than the first threshold value. The output value of the sheet width sensor 16 is input to the control unit 304. In a case of an example shown in FIG. 4, the distance between the sheet width sensors 16A and 16B, which is the first threshold value, is 190 mm, and the control unit 304 recognizes the sheet with the sheet length less than 190 mm in the width direction as a small size sheet.

Configuration of Fixing Unit

Figure 5:
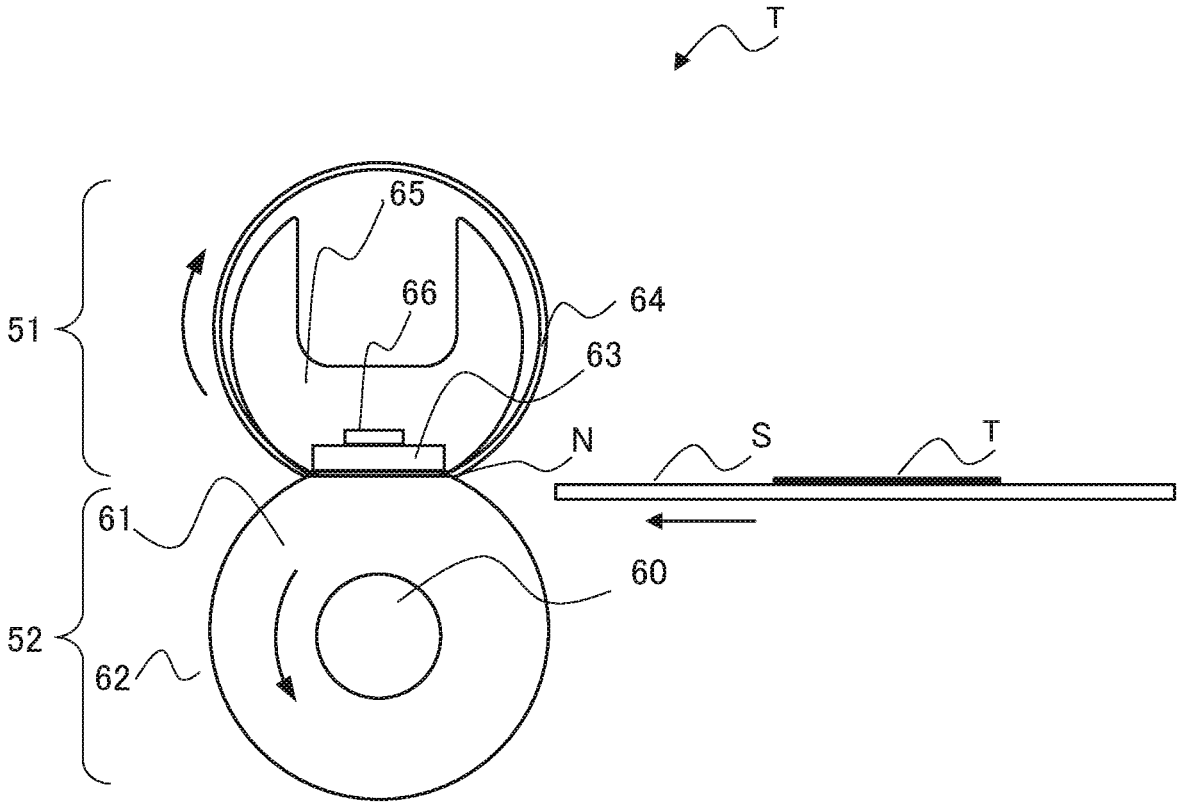
FIG. 5 is a schematic cross-sectional view of a fixing unit according to the first embodiment.

Next, with reference to FIG. 5, a configuration of the fixing unit 50 of this embodiment will be described. FIG. 5 is a schematic cross-sectional view of the fixing unit 50. The fixing unit 50 includes a film unit 51 and a pressing roller 52. The film unit 51 is constituted by including a fixing film 64, serving as a tubular rotary member, a heater 63, serving as a heating element, and a heater holder 65 supporting the heater 63. Further, the pressing roller 52 constituting a rotary member pair with the fixing film 64 is an elastic rotary member, and is disposed at a position facing the film unit 51. The fixing film 64 and the pressing roller 52 form the nip portion N through which the sheet S passes at the fixing unit 50. A toner T carried on the sheet S conveyed to the nip portion N is heated by the heater 63 via the fixing film 64, and pressed by the pressing roller 52. Herewith, the toner T is fixed on the sheet S.

The heater 63 is constituted by a resistance heating element of silver palladium alloy and the like disposed on a ceramic board of alumina and the like, and the resistance heating element is coated with an over coat glass so that insulation and wear resistance properties of the resistance heating element are improved. The heater 63 is disposed inside the fixing film 64, and a layer of the over coat glass comes into contact with an inner peripheral surface of the fixing film 64. To be noted, so as to improve lubricity with the fixing film 64, a small quantity of lubricant such as heat resistance grease is coated on a surface of the heater 63. On a surface opposite a sliding surface, on which the heater 63 and the fixing film 64 come into contact with each other, of the heater 63, a thermistor 66 is disposed. Based on a detection signal of the thermistor 66, the control unit 304 controls, via the fixing control unit 320 (refer to FIG. 2), an electrical current energized to the heater 63 so that the heater 63 is brought to a desired target temperature.

The fixing film 64 is formed as a composite layer film and includes a base layer which is cylindrically formed by a metal thin tube blank of such as stainless steel and kneaded matter of a heat resistance resin such as polyimide and a thermally conductive filler such as graphite and a releasing layer coating or tube-covering a surface of the base layer, directly or via a primer layer. The releasing layer is formed of PFA (p-fluorophenylalanine), PTFE (polytetrafluoroethylene), FEP (fluorinated ethylene-propylene copolymer), and the like. The fixing film 64 used in this embodiment is coated with PFA on the surface of the base layer formed by polyimide, and a total film thickness and a circumferential length are respectively 70 μm and 57 mm. The pressing roller 52 consists of an elastic layer 61, which is formed by foaming a heat resistance rubber, such as a silicon rubber and a fluoro rubber having an insulating property, on a core metal 60 made of iron and the like, and the elastic layer is coated with a RTV (room temperature vulcanizing) silicone rubber having an adhesive property. Further, the pressing roller 52 consists of a releasing layer 62 which is formed by covering, or by applying a coating method, with a tube dispersing a conductive agent such as carbon in PFA, PTFE, FEP, and the like. In this embodiment, the silicon rubber is used for the elastic layer 61, an outer diameter and a roller hardness of the pressing roller 52 are respectively 18 mm and 48° (Asker-C, weight load 600 g). The pressing roller 52 is pressed by a pressing member, not shown, with pressure of 180 N (newtons) so as to form the nip portion N extending between both edges in an axial direction with the fixing film 64 in between. Further, the pressing roller 52 is rotatably driven from the edge in the axial direction by a rotational driving unit, not shown, in an arrow direction in FIG. 5 (counter-clockwise direction) via the core metal 60. Herewith, the fixing film 64 is rotatably driven in an arrow direction in FIG. 5 (clockwise direction) around an outside of the heater holder 65.

The heater holder 65 is formed by a liquid crystal polymer, a phenol resin, PPS (polyphenylene sulfide), PEEK (polyetheretherketone), and the like, and supports the heater 63. The fixing film 64 is externally fitted to the heater holder 65 with a margin, and disposed freely rotatably. The sheet S passes through the nip portion N formed between the pressing roller 52 and the fixing film 64. Heat supplied from the heater 63 heats the sheet S at the nip portion N via the fixing film 64. An unfixed toner T carried on the sheet S is melted by the heat received from the heated fixing film 64 and the pressure at the nip portion N, and fixed on the sheet S. The fixing control unit 320 includes a temperature control program to control a temperature of the heater 63, and the control unit 304 performs control so that the temperature of the heater 63 is brought to the desired target temperature based on a detected temperature of the thermistor 66. As a control method, a PID (proportional integral and differential) control consisting of a proportional term, an integral term, and a differential term is preferred. An energization time of the heater 63 in a cycle is determined by the PID control, and an output power to the heater 63 is determined by driving a heater energization time control circuit, not shown. In this embodiment, the output power to the heater 63 is updated in every 100 milliseconds as a control cycle.

Relationship Between Sheet Non-passing Portion Temperature Rise and Throughput

In the fixing unit 50, a length of a resistance heating layer of the heater 63 in the axial direction of the fixing film 64 is set at a length at which a fixability of the toner to the sheet at edges of the maximum size sheet usable by the printer 1 is ensured. On the other hand, in a case where the sheet with a small length in the width direction (narrow width sheet) passes through the nip portion N, it occurs that the heat is not transmitted to the sheet, and accumulated to cause a high temperature in each of the heater 63, the fixing film 64, the pressing roller 52, and the like. A phenomenon in which a temperature rise at a sheet non-passing portion in the nip portion N (sheet non-passing portion) becomes larger than a temperature rise at a sheet passing portion is referred to as a sheet non-passing portion temperature rise. Regarding the sheet non-passing portion temperature rise, the shorter the sheet length in the width direction is, the larger a difference in heat consumption between the sheet passing portion and the sheet non-passing portion and the larger the temperature rise at the sheet non-passing portion become. When an extent of the sheet non-passing portion temperature rise becomes larger, since the pressing roller 52 of the pressing roller 52 disproportionally expands with the heat and a feed speed of the fixing film 64 deviates, a problem such as wrinkles on the sheet and defective fixing of the toner occurs.

In a conventional printer, so as to prevent the problem caused by the sheet non-passing portion temperature rise, as shown in an operation in a reference example, in a case where the sheet passing through the nip portion N is the small size sheet, control to lengthen a feed interval of the sheet, so-called control to decrease the throughput, is performed. At this point, a sheet conveyance operation in the reference example will be described. Based on the input job information, the control unit 304 controls to bring each unit of the printer 1 to execute the image forming operation. When the image forming engine 1A starts the image formation at the predetermined process speed, the feed of the sheet from the feed cassette 20 is started. When the sheet passes through the registration roller pair 29, the leading edge of the sheet reaches the detection position of the sheet width sensor 16. At this time, depending on whether or not the lever member of the sheet width sensor 16 is brought down, the control unit 304 judges whether the sheet fed from the feed cassette 20 is a normal size or the small size.

In the example shown in FIG. 4, when the lever member of the sheet width sensor 16 is not brought down and it is identified that the sheet is the small size sheet, it is known that the sheet length in the width direction is less than 190 mm, but an exact sheet length in the width direction is unknown. Therefore, there is not enough evidence to judge whether or not the sheet specified by the user in the sheet size information included in the job information is the sheet actually used in the image forming operation. Further, since the sheet non-passing portion temperature rise occurs during the passage of the sheet through the nip portion N, it is possible to reduce the temperature rise by extending a time (sheet gap) of the sheet not existing in the nip portion N. However, in a case where the sheet length in the width direction is judged based on the output values of two sensors, such as the sheet width sensors 16A and 16B, whether or not to extend the sheet gap is judged in two cases of whether the sheet is the normal size (for example, A4 size) or the small size. At this point, in a case where it is judged to be the small size sheet, so as to prevent the problem from the sheet non-passing portion temperature rise, it is necessary to set the sheet gap on the assumption that the sheet length in the width direction is the minimum sheet length at which the extent of the sheet non-passing portion temperature rise is maximized. At this point, as the minimum sheet length in the width direction, 105 mm which is the sheet length in the width direction of a Com #10 size (105 mm×241 mm) is assumed. Therefore, in a case where an actually used sheet is the small size sheet but the sheet length in the width direction is relatively large (for example, 182 mm, equivalent to the B5 size), the sheet gap is widened more than necessary, and printing productivity is decreased.

Sheet Conveyance Operation

Figure 6:
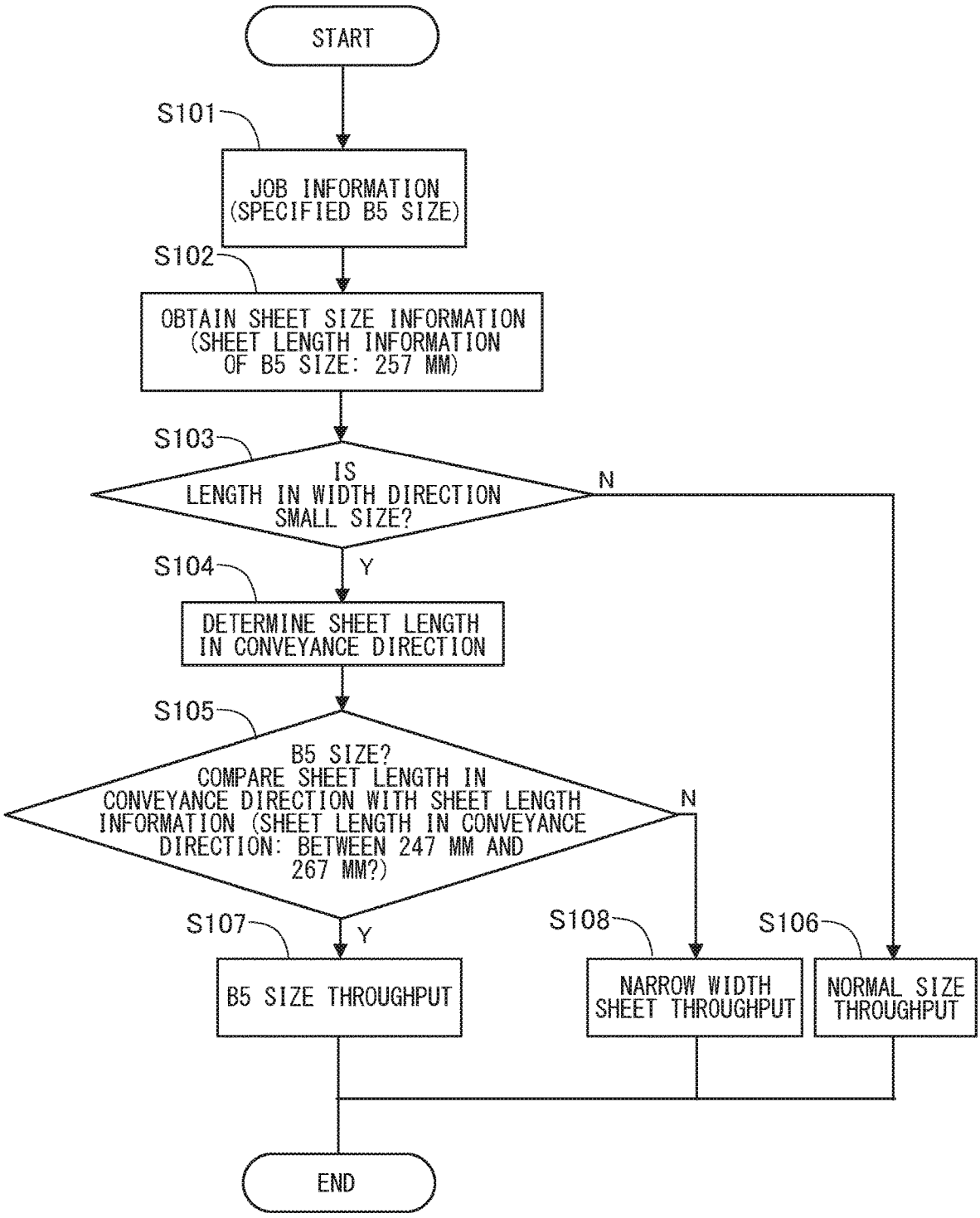
FIG. 6 is a flowchart showing a flow of a sheet conveyance operation control according to the first embodiment.

As described above, by the sheet conveyance operation of the reference example, it is possible to suppress an effect of the sheet non-passing portion temperature rise, but, on the other hand, it involves a problem that causes damage to the printing productivity. On the other hand, by a sheet conveyance operation control of this embodiment, the sheet feed interval from the feed cassette 20 is changed based on the output value of the sheet length sensor 15. With reference to FIG. 6, a flow of the sheet conveyance operation control of this embodiment will be described. FIG. 6 is a flowchart showing the flow of the sheet conveyance operation control. In FIG. 6, descriptions are provided on the assumption that the sheet with a sheet size equal to or smaller than the B5 size is the small size sheet. Further, the flowchart shown in FIG. 6 is mainly performed by the control unit 304. Based on the input job information, the control unit 304 controls to bring each unit of the printer 1 to execute the image forming operation (STEP S101). At this time, the control unit 304 obtains the sheet size information which is instructed in the job information continuously conveying a plurality of sheets (STEP S102). It is possible to separate the sheet size information into information on the sheet length in the sheet conveyance direction (hereinafter referred to as sheet length information) and information on the sheet length orthogonally intersecting with the sheet conveyance direction (hereinafter referred to as sheet width information). At this point, the sheet length information and the sheet width information of the B5 size are respectively 257 mm and 182 mm.

When the image forming engine 1A starts the image formation with the predetermined process speed, the sheet conveyance from the feed cassette 20 is started. When the sheet passes through the registration roller pair 29, the leading edge of the sheet reaches the detection position of the sheet width sensor 16. At this time, in a case where the lever member of the sheet width sensor 16 is brought down and the ON signal is output, it is judged that the fed sheet is not the small size sheet (STEP S103: NO). In a case where the fed sheet is not the small size sheet, the control unit 304 performs the feed and conveyance of the sheet by setting the sheet feed interval at the feed interval suitable for the normal size sheet (for example, the feed interval suitable for the A4 size sheet is a fourth time) (STEP S106).

On the other hand, in a case where the lever member of the sheet width sensor 16 is not brought down and the OFF signal is output, it is judged that the fed sheet is the small size sheet (STEP S103: YES). In a case where the fed sheet is the small size sheet, the control unit 304 determines the sheet length in the sheet conveyance direction based on the sheet conveyance speed and the output value of the sheet length sensor 15 (STEP S104). At this point, the sheet conveyance speed is, for example, the speed equivalent to the process speed of the image forming engine 1A. Then, it is judged whether or not the sheet length in the conveyance direction determined at STEP S104 is a length corresponding to the sheet length information of the sheet size information (STEP S105). To be noted, in this embodiment, taking into consideration a detection error of the sheet length sensor 15, within 10 mm of the length in the sheet length information of the sheet size information is regarded as corresponding to the length of the sheet length information in the sheet conveyance direction. In a case where the output value of the sheet length sensor 15 is an output value corresponding to the length of the sheet length information in the sheet conveyance direction (STEP S105: YES), it is judged that the length of the fed sheet corresponds to the length (B5 size) of the sheet length information of the sheet size information. Then, by setting the sheet feed interval at the B5 size (for example, a fifth time which is a feed interval longer than the feed interval of the A4 size) (STEP S107), the feed and the conveyance of the sheet are performed. On the other hand, in a case where the output value of the sheet length sensor 15 is not the output value corresponding to the length of the sheet length information in the sheet conveyance direction (STEP S105: NO), it is judged that the length of the fed sheet does not correspond to the length of the sheet length information of the sheet size information. Then, by setting the sheet feed interval at a sixth time (STEP S108) which is a feed interval longer than the feed interval of the B5 size, the feed and the conveyance of the sheet are performed.

As described above, in this embodiment, in a case where, based on the output value of the sheet width sensor 16, it is judged that the small size sheet is fed, the length of the fed sheet in the sheet conveyance direction is judged based on the output value of the sheet length sensor 15. Then, in a case where the judged sheet length in the sheet conveyance direction does not correspond to the length of the sheet size information specified by the job, the sheet feed interval is set at longer than the feed interval of the sheet size specified by the sheet size information. By performing the control as described above, an arrival time between the passage of the trailing edge of the preceding sheet antecedently conveyed to the nip portion N through the nip portion N and an arrival of the leading edge of the succeeding sheet succeeding to the preceding sheet at the nip portion N is changed. In particular, in the case where the lever member of the sheet width sensor 16 is brought down and the ON signal is output, a first mode by which the feed and the conveyance of the sheet from the feed cassette 20 is controlled so that the arrival time becomes a first time (an arrival time suitable for the A4 size) is performed. Further, in the case where the lever member of the sheet width sensor 16 is not brought down and the OFF signal is output, following two modes of controls are performed. In the case where the output value of the sheet length sensor 15 corresponds to the sheet length information, a second mode in which the feed and the conveyance of the sheet from the feed cassette 20 are controlled so that the arrival time becomes a time (second time) longer than the arrival time suitable for the A4 size is performed. On the other hand, in the case where the output value of the sheet length sensor 15 does not correspond to the sheet length information, a third mode in which the feed and the conveyance of the sheet from the feed cassette 20 are controlled so that the arrival time becomes a third time longer than the second time is performed. As described above, corresponding to the output values of the sheet length sensor 15 and the sheet width sensor 16, the printer 1 is capable of performing the first, second, and third modes. Accordingly, in the case where the small size sheet is fed, the feed and the conveyance of the sheet are performed at an interval suitable for the sheet size specified by the sheet size information in the case where the sheet length of the small size sheet corresponds to the length in the sheet conveyance direction of the sheet size information specified by the job.

To be noted, it is acceptable to judge through the job whether or not the sheet length in the sheet conveyance direction corresponds to the sheet length information of the sheet size information. In this case, in a case where the length has changed from a corresponding length to a not corresponding length to the sheet length information during an execution of the job, it is suitable to perform the job by switching the mode from the second mode to the third mode.

Figure 7:
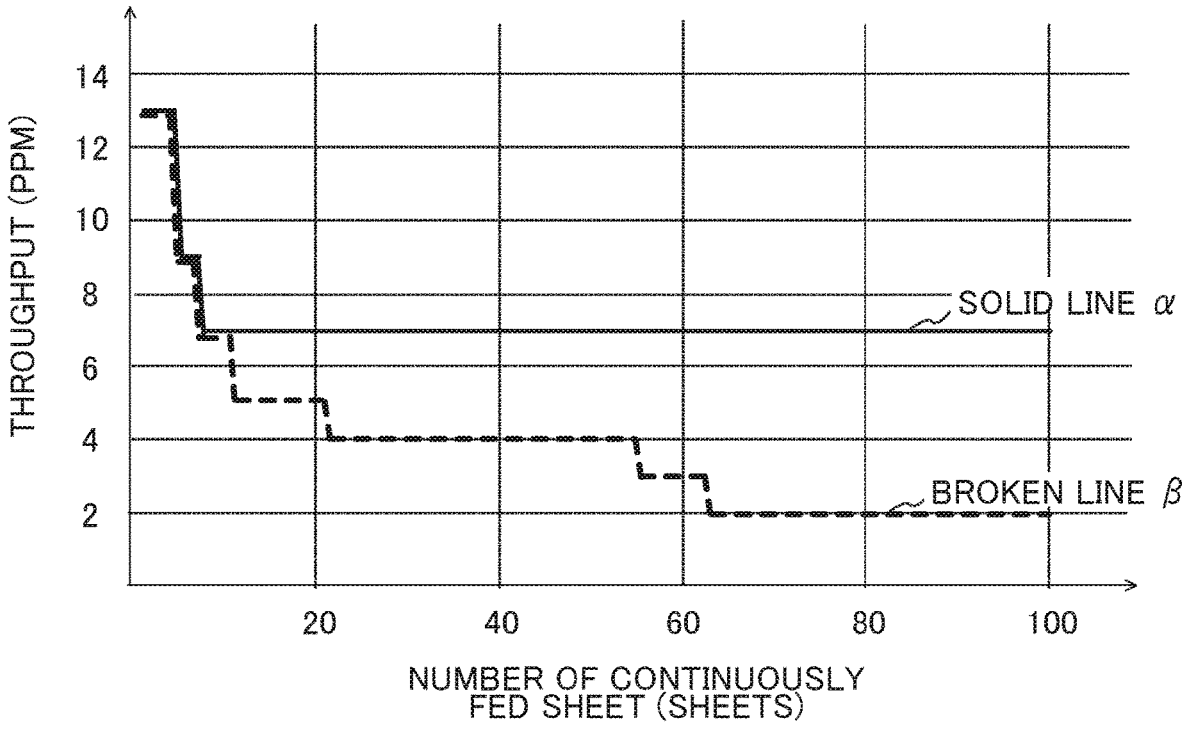
FIG. 7 is a diagram showing results of the sheet conveyance operation control according to the first embodiment.

FIG. 7 is a diagram showing a comparison result of throughputs of the sheet conveyance operation control of FIG. 6 and the control of the reference example. In comparing the throughputs, it is assumed that the image formed on the sheet is a text image (not shown) with a coverage rate of 4%, and, in the setting screen 210 (refer to FIG. 3), the B5 size 211C, a single side, a full color, and 100 (copies) are respectively set for the sheet size, single side/duplex, a mode, and a number of copies. Further, it is assumed that 100 sheets of the B5 size sheet are set in the feed cassette 20 and the image forming operation is started by tapping the OK button 212. As the B5 size sheet, CS-068 (trade name of Cannon Marketing Japan Inc.) with a grammage of 68 g/m2 is used. In FIG. 7, a horizontal axis and a vertical axis respectively show a number of continuously fed sheets and the throughput (sheet feed interval) determined between the Nth sheet and N+1th sheet of the number of continuously fed sheets, and a solid line α and a broken line β respectively show the result of the sheet conveyance operation control of FIG. 6 and the result of the sheet conveyance operation control of the reference example.

From FIG. 3, although both of the solid line α and the broken line β declines to 7 ppm before the 10th sheet of the number of continuously fed sheets, the throughput of the solid line α does not decline in subsequent feeds. On the other hand, since, in a case of the broken line β, the feed interval of the sheet is widened assuming the Com #10 size sheet narrower than the B5 size in the width direction, the throughput declines on and after the 10th sheet, and falls to 2 ppm at the 70th sheet. In this embodiment, in the case where the small size sheet is fed, when the length of the small size sheet corresponds to the length of the sheet size information specified by the job in the sheet conveyance direction, the feed and the conveyance of the sheet are performed at the interval suitable for the sheet size specified by the sheet size information. By performing the control as described above, in this embodiment, it is possible to suppress the effect of the sheet non-passing portion temperature rise, and, since the sheet gap is not widened more than necessary, it is possible to improve the printing productivity.

Alternative Embodiment

In the first embodiment, the sheet length in the sheet conveyance direction is determined by defining singly the length in the sheet conveyance direction corresponding to the sheet size information specified by the job. In an alternative embodiment of the first embodiment, the feed and the conveyance of the sheet are controlled with the interval suitable for the length of the actually fed sheet in the sheet conveyance direction by defining the sheet sizes specified by the sheet size information (B5 size and A5 size) doubly.

Figure 8A:
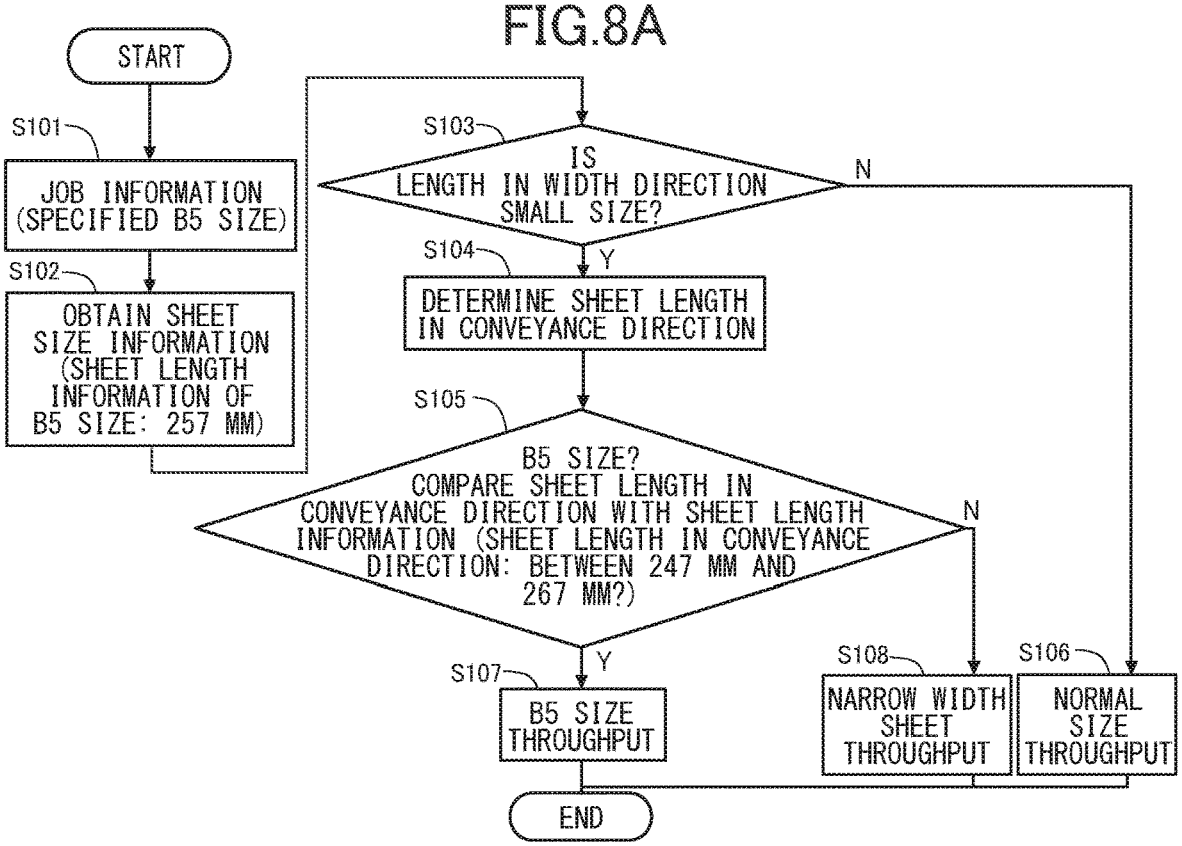
FIGS. 8A and 8B are flowcharts showing a flow of a sheet conveyance operation control according to an embodiment alternative to the first embodiment.
Figure 8B:
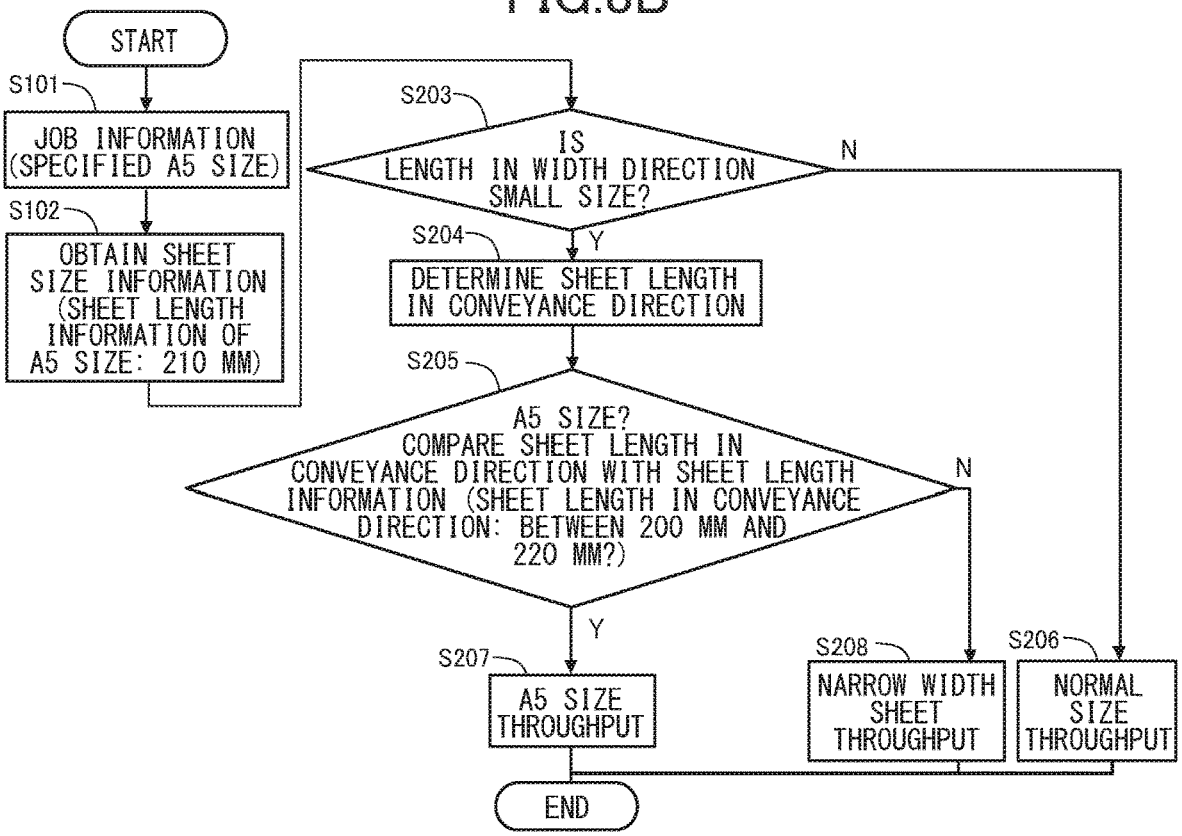

With reference to FIGS. 8A and 8B, a flow of the sheet conveyance operation control of this alternative embodiment will be described. FIGS. 8A and 8B are flowcharts showing the flow of the sheet conveyance operation control. In FIGS. 8A and 8B, descriptions are provided on the assumption that a sheet with equal to or smaller than the B5 size is the small size sheet. Further, the flowcharts of FIGS. 8A and 8B are mainly performed by the control unit 304. In the flowcharts of FIGS. 8A and 8B, the same step as the flowchart of FIG. 6 is put with the same mark, and duplicating descriptions will be omitted herein. Based on the input job information, the control unit 304 controls to bring each unit of the printer 1 to execute the image forming operation (STEP S101). At this time, the control unit 304 obtains the sheet size information which is specified in the job information continuously conveying a plurality of sheets (STEP S102). It is possible to separate the sheet size information into information on the sheet length in the sheet conveyance direction (hereinafter referred to as sheet length information) and information on the sheet length orthogonally intersecting with the sheet conveyance direction (hereinafter referred to as sheet width information). At this point, the sheet length information and the sheet width information of the B5 size are respectively 257 mm and 182 mm. Further, the sheet length information and the sheet width information of the A5 size sheet are respectively 210 mm and 148 mm. When the B5 size is specified by the sheet size information, the control unit 304 proceeds to STEP S103, and, when the A5 size is specified, the control unit 304 proceeds to STEP S203. To be noted, since, when the B5 size is specified by the sheet size information, steps subsequent to STEP S103 is similar to the flowchart of FIG. 6, duplicating descriptions will be omitted herein, and steps subsequent to STEP S103, when the A5 size is specified by the sheet size information, will be described.

When the image forming engine 1A starts the image formation with the predetermined process speed, the sheet conveyance from the feed cassette 20 is started. When the sheet passes through the registration roller pair 29, the leading edge of the sheet reaches the detection position of the sheet width sensor 16. At this time, in a case where the lever member of the sheet width sensor 16 is brought down and the ON signal is output, it is judged that the fed sheet is not the small size sheet (STEP S203: NO). In a case where the fed sheet is not the small size sheet, the control unit 304 performs the feed and conveyance of the sheet by setting the sheet feed interval at the normal size (for example, the feed interval suitable for the A4 size sheet) (STEP S206).

On the other hand, in a case where the lever member of the sheet width sensor 16 is not brought down and the OFF signal is output, it is judged that the fed sheet is the small size sheet (STEP S203: YES). In a case where the fed sheet is the small size sheet, the control unit 304 determines the sheet length in the sheet conveyance direction based on the sheet conveyance speed and the output value of the sheet length sensor 15 (STEP S204). At this point, the sheet conveyance speed is, for example, the speed equivalent to the process speed of the image forming engine 1A. Then, it is judged whether or not the sheet length in the conveyance direction determined at STEP S104 is a length corresponding to the sheet length information of the sheet size information (STEP S205). To be noted, in this embodiment, taking into consideration a detection error of the sheet length sensor 15, within 10 mm of the length in the sheet length information of the sheet size information is regarded as corresponding to the length of the sheet length information in the sheet conveyance direction. In a case where the output value of the sheet length sensor 15 is an output value corresponding to the length of the sheet length information in the sheet conveyance direction (STEP S205: YES), it is judged that the length of the fed sheet corresponds to the length (A5 size) of the sheet length information of the sheet size information. Then, by setting the sheet feed interval at the A5 size (for example, a feed interval longer than the feed interval of the A4 size) (STEP S207), the feed and the conveyance of the sheet are performed. On the other hand, in a case where the output value of the sheet length sensor 15 is not the output value corresponding to the length of the sheet length information in the sheet conveyance direction (STEP S205: NO), it is judged that the length of the fed sheet does not correspond to the length of the sheet length information of the sheet size information. Then, by setting the sheet feed interval at a feed interval longer than the feed interval of the A5 size (STEP S208), the feed and the conveyance of the sheet are performed.

Figure 9:
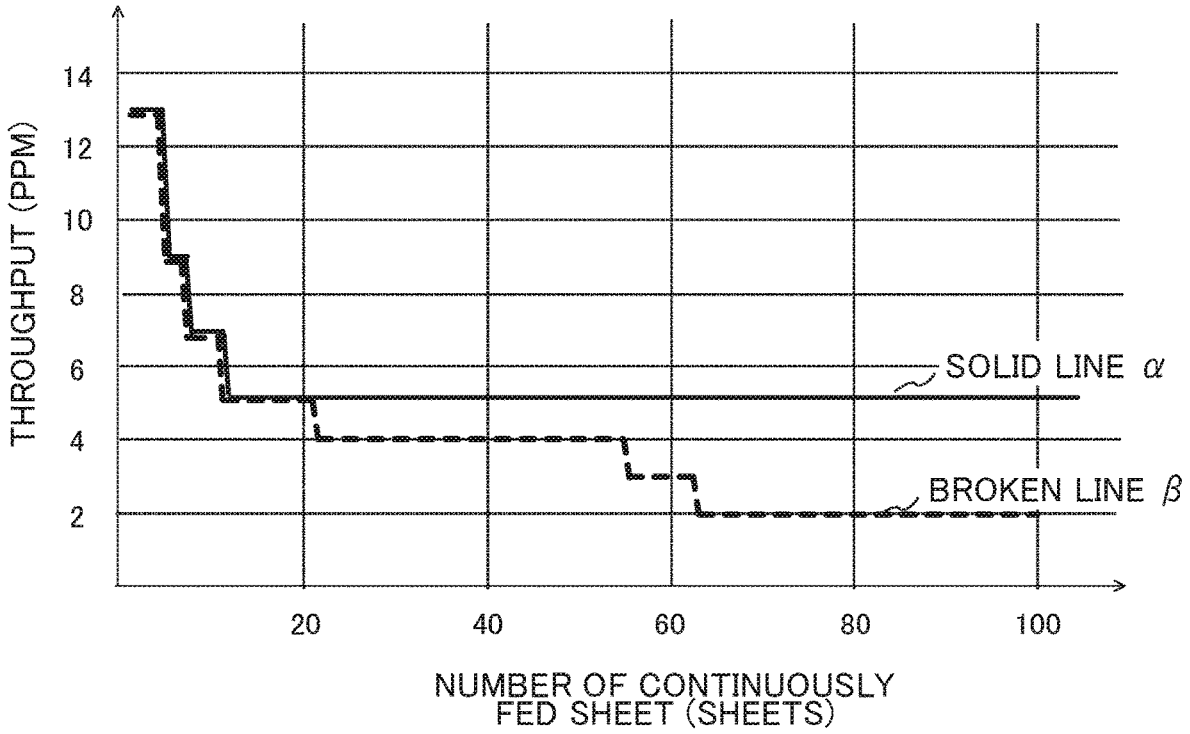
FIG. 9 is a diagram showing results of the sheet conveyance operation control according to the embodiment alternative to the first embodiment.

FIG. 9 is a diagram showing a comparison result of throughputs of the sheet conveyance operation control of FIG. 6 and the sheet conveyance operation control of FIGS. 8A and 8B. In comparing the throughputs, it is assumed that the image formed on the sheet is a text image (not shown) with a coverage rate of 4%, and, in the setting screen 210 (refer to FIG. 3), the A5 size 211D, a single side, a full color, and 100 (copies) are respectively set for the sheet size, single side/duplex, a mode, and a number of copies. Further, it is assumed that 100 sheets of the A5 size sheet are set in the feed cassette 20 and the image forming operation is started by tapping the OK button 212. As the A5 size sheet, PB PAPER A5 (trade name of Cannon Marketing Japan Inc.) with a grammage of 64 g/m2 is used. In FIG. 9, a horizontal axis and a vertical axis respectively show a number of continuously fed sheets and the throughput (sheet feed interval) determined between the Nth sheet and N+1th sheet of the number of continuously fed sheets, and a solid line α and a broken line β respectively show the result of the sheet conveyance operation control of FIGS. 8A and 8B and the result of the sheet conveyance operation control of FIG. 6.

From FIG. 9, although both of the solid line α and the broken line β declines to 5 ppm before the 10th sheet of the number of continuously fed sheets, the throughput of the solid line α does not decline in subsequent feeds. On the other hand, since the feed interval of the sheet is widened assuming the Com #10 size sheet is narrower than the A5 size in the width direction in a case of the broken line β, the throughput declines on and after the 10th sheet, and falls to 2 ppm at the 70th sheet. By performing the control as described above, in this alternative embodiment, it is also possible to suppress the effect of the sheet non-passing portion temperature rise, and, since the sheet gap is not widened more than necessary, it is possible to improve the printing productivity. To be noted, it is acceptable to specify equal to more than 2 sheet sizes in the sheet size information, and change the sheet feed interval by defining a business card size and a postcard size as the sheet size other than the A5 and B5 sizes.

Second Embodiment

In the first embodiment, the sheet length in the sheet conveyance direction is determined by defining singly the length in the sheet conveyance direction corresponding to the sheet size information specified by the job. Incidentally, sheet sizes usable for the printer 1 include a sheet size called an EXE size with the sheet length of 184 mm in the width direction and the sheet length of 267 mm in the sheet conveyance direction. In a case where the EXE size sheet is fed in the job, by the flowchart shown in FIG. 6, it sometimes occurs that the feed and the conveyance of the sheet are performed by widening the sheet feed interval longer than the feed interval of the B5 size. Since there are a little differences in sizes between the EXE size (184 mm×267 mm) and the B5 size (182 mm×257 mm), it is assumed that there are little differences in the effects of the sheet non-passing portion temperature rise. Therefore, in this embodiment, a determination threshold value to judge the sheet length in the sheet conveyance direction is increased. Herewith, it is intended to achieve both the suppression of the effect of the sheet non-passing portion temperature rise and the improvement of the printing productivity also in a case where the image formation is performed by using a sheet with a size similar to the size of the sheet specified by the sheet size information.

Figure 10:
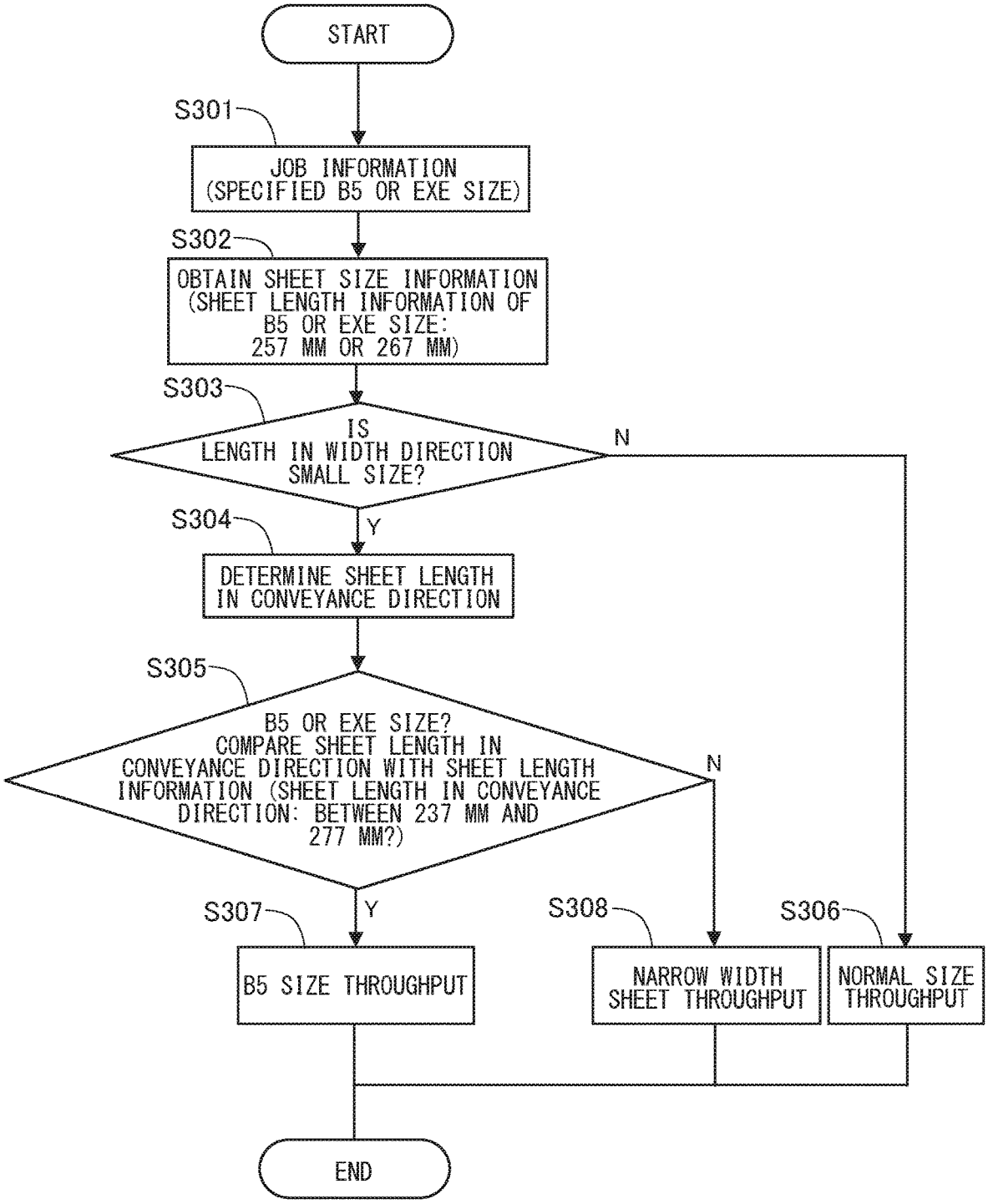
FIG. 10 is a flowchart showing a flow of a sheet conveyance operation control according to a second embodiment.

With reference to FIG. 10, a flow of the sheet conveyance operation control of this embodiment will be described. FIG. 10 is a flowchart showing the flow of the sheet conveyance operation control. In FIG. 10, descriptions are provided on the assumption that a sheet with a size equal to or smaller than the B5 size is the small size sheet. Further, the flowchart of FIG. 10 is mainly performed by the control unit 304. Based on the input job information, the control unit 304 controls to bring each unit of the printer 1 to execute the image forming operation (STEP S301). At this time, the control unit 304 obtains the sheet size information which is specified in the job information continuously conveying a plurality of sheets (STEP S302). It is possible to separate the sheet size information into information on the sheet length in the sheet conveyance direction (hereinafter referred to as sheet length information) and information on the sheet length orthogonally intersecting with the sheet conveyance direction (hereinafter referred to as sheet width information). At this point, the sheet length information and the sheet width information of the B5 size are respectively 257 mm and 182 mm. Further, the sheet length information and the sheet width information of the EXE size are respectively 267 mm and 184 mm.

When the image forming engine 1A starts the image formation with the predetermined process speed, the sheet conveyance from the feed cassette 20 is started. When the sheet passes through the registration roller pair 29, the leading edge of the sheet reaches the detection position of the sheet width sensor 16. At this time, in a case where the lever member of the sheet width sensor 16 is brought down and the ON signal is output, it is judged that the fed sheet is not the small size sheet (STEP S303: NO). In a case where the fed sheet is not the small size sheet, the control unit 304 performs the feed and conveyance of the sheet by setting the sheet feed interval at the feed interval suitable for the normal size sheet (for example, the feed interval suitable for the A4 size sheet) (STEP S306).

On the other hand, in a case where the lever member of the sheet width sensor 16 is not brought down and the OFF signal is output, it is judged that the fed sheet is the small size sheet (STEP S303: YES). To be noted, since the sheet width sensors 16A and 16B are disposed at the distance of 190 mm, in a case where the fed sheet is a sheet with the EXE size, it is also judged that the fed sheet is the small size sheet. In a case where the fed sheet is the small size sheet, the control unit 304 determines the sheet length in the sheet conveyance direction based on the sheet conveyance speed and the output value of the sheet length sensor 15 (STEP S304). At this point, the sheet conveyance speed is, for example, the speed equivalent to the process speed of the image forming engine 1A. Then, it is judged whether or not the sheet length in the sheet conveyance direction determined at STEP S304 is a length corresponding to the sheet length information of the sheet size information (STEP S305).

To be noted, in this embodiment, taking into consideration the detection error of the sheet length sensor 15, within 20 mm of the length in the sheet length information of the sheet size information is regarded as corresponding to the length of the sheet length information in the sheet conveyance direction. Herewith, it becomes possible to judge whether or not the sheet length in the sheet conveyance direction is a length corresponding to the B5 and EXE size sheets. In a case where the output value of the sheet length sensor 15 is an output value corresponding to the length of the sheet length information in the sheet conveyance direction (STEP S305: YES), it is judged that the length of the fed sheet corresponds to the length (B5 or EXE size) of the sheet length information of the sheet size information. Then, by setting the sheet feed interval at the B5 size or the EXE size (for example, a feed interval longer than the feed interval of the A4 size) (S307), the feed and the conveyance of the sheet are performed. On the other hand, in a case where the output value of the sheet length sensor 15 is not the output value corresponding to the length of the sheet length information in the sheet conveyance direction (STEP S305: NO), it is judged that the length of the fed sheet does not correspond to the length of the sheet length information of the sheet size information. Then, by setting the sheet feed interval at a feed interval longer than the feed interval of the B5 or EXE size (STEP S308), the feed and the conveyance of the sheet are performed.

As described above, in this embodiment, an arrival time between the passage of the trailing edge of the preceding sheet antecedently conveyed to the nip portion N through the nip portion N and an arrival of the leading edge of the succeeding sheet succeeding to the preceding sheet at the nip portion N is changed. In particular, in the case where the lever member of the sheet width sensor 16 is brought down and the ON signal is output, a first mode in which the feed and the conveyance of the sheet from the feed cassette 20 are controlled so that the arrival time becomes a first time (an arrival time suitable for the A4 size) is performed. Further, in the case where the lever member of the sheet width sensor 16 is not brought down and the OFF signal is output, following two modes of controls are performed. In the case where the output value of the sheet length sensor 15 corresponds to the sheet length information (B5 or EXE size), a second mode in which the feed and the conveyance of the sheet from the feed cassette 20 are controlled so that the arrival time becomes a time (second time) longer than the arrival time suitable for the A4 size is performed. On the other hand, in the case where the output value of the sheet length sensor 15 does not correspond to the sheet length information (B5 or EXE size), a third mode in which the feed and the conveyance of the sheet from the feed cassette 20 are controlled so that the arrival time becomes a third time which is longer than the second time is performed.

Accordingly, in the case where the small size sheet is fed, the feed and the conveyance of the sheet are performed at an interval suitable for the sheet size specified by the sheet size information in the case where the sheet length of the small size sheet corresponds to the length in the sheet conveyance direction of the sheet size information specified by the job. Further, also in a case where the size of the small size sheet is similar to the size of the sheet size information specified by the job, the feed and the conveyance of the sheet are performed at an interval suitable for the size specified by the sheet size information. Herewith, it is possible to achieve the suppression of the effect of the sheet non-passing portion temperature rise, and, since the sheet gap is not widened more than necessary, it is possible to improve the printing productivity. Further, also in a case where a sheet with a size similar to the size of the sheet specified by the sheet size information is fed, it is possible to achieve both the suppression of the effect of the sheet non-passing portion temperature rise and the improvement of the printing productivity.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-108953, filed Jun. 24, 2020, which is hereby incorporated by reference herein in its entirety.

What is claimed is:

1. An image forming apparatus comprising:

an image forming unit configured to form a toner image on a sheet;

a sheet conveyance unit configured to convey the sheet toward the image forming unit in a sheet conveyance direction;

a fixing unit comprising a rotary member pair configured to form a nip portion and a heating element configured to heat the nip portion, the fixing unit being configured to fix the toner image on the sheet by heating the sheet on which the toner image is formed at the nip portion;

a sheet width detection unit configured to output a first signal and a second signal, the sheet width detection unit being configured to output the first signal in a case where a sheet length in a width direction orthogonal to the sheet conveyance direction is equal to or larger than a first threshold value, the sheet width detection unit being configured to output the second signal in a case where the sheet length in the width direction is less than the first threshold value;

a sheet length detection unit configured to output an output value corresponding to a sheet length in the sheet conveyance direction; and a control unit configured to perform a first mode, a second mode, and a third mode, the first mode being a mode in which the sheet conveyance unit is controlled so that in a job continuously conveying a plurality of sheets, an arrival time from a passage of a trailing edge of a preceding sheet through the nip portion to an arrival of a leading edge of a succeeding sheet succeeding to the preceding sheet at the nip portion becomes a first time, the second mode being a mode in which the sheet conveyance unit is controlled so that the arrival time becomes a second time, the third mode being a mode in which the sheet conveyance unit is controlled so that the arrival time becomes a third time, the second time being longer than the first time, the third time being longer than the second time, wherein the control unit is configured to perform the first mode in a case where the sheet width detection unit outputs the first signal, and configured to perform the third mode in a case where the sheet width detection unit outputs the second signal and the sheet length detection unit outputs the output value not corresponding to a length, in the sheet conveyance direction, of a sheet size information specified by the job, and configured to perform the second mode in a case where the sheet width detection unit outputs the second signal and the sheet length detection unit outputs the output value corresponding to the length, in the sheet conveyance direction, of the sheet size information.

2. The image forming apparatus according to claim 1, wherein the control unit is configured to perform the third mode in a case where the sheet width detection unit outputs the second signal and the sheet length detection unit outputs the output value not corresponding to the length, in the sheet conveyance direction, of the sheet size information specified by the job or the output value not corresponding to a length, in the sheet conveyance direction, of a size of a sheet similar to the sheet size information, and configured to perform the second mode in a case where the sheet width detection unit outputs the second signal and the sheet length detection unit outputs the output value corresponding to the length, in the sheet conveyance direction, of the sheet size information or the output value corresponding to a length, in the sheet conveyance direction, of a size of a sheet similar to the sheet size information.

3. The image forming apparatus according to claim 1, wherein the sheet conveyance unit comprises a sheet feed unit configured to feed the sheet toward the image forming unit, and wherein the control unit is configured to control the sheet feed unit so that a feed interval between a start of a feed of the preceding sheet and a start of a feed of the succeeding sheet in the first mode becomes a fourth time, and configured to control the sheet feed unit so that the feed interval in the second mode becomes a fifth time, and configured to control the sheet feed unit so that the feed interval in the third mode becomes a sixth time, the fifth time being longer than the fourth time, the sixth time being longer than the fifth time.

4. The image forming apparatus according to claim 3, wherein the sheet conveyance unit comprises a registration roller pair rotatably disposed between the sheet feed unit and the image forming unit in the sheet conveyance direction and configured to correct a skew of the sheet by abutting on a leading edge of the sheet in a stopped state, and wherein the sheet width detection unit and the sheet length detection unit are disposed between the registration roller pair and the image forming unit in the sheet conveyance direction.

5. The image forming apparatus according to claim 1, wherein the control unit is configured to perform control so that a target temperature of the heating element is a same during execution of the job regardless of the first mode, the second mode, or the third mode.

6. The image forming apparatus according to claim 1, wherein the rotary member pair comprises a tubular fixing film and a pressing roller configured to form the nip portion with the fixing film, and wherein the heating element is disposed inside the fixing film, and configured to heat the nip portion via the fixing film.

7. The image forming apparatus according to claim 1, wherein the sheet width detection unit is configured to output the first signal in a case where a size of the sheet conveyed by the sheet conveyance unit is an A4 size, and configured to output the second signal in a case where the size of the sheet conveyed by the sheet conveyance unit is a B5 size.

8. The image forming apparatus according to claim 1, wherein the control unit is configured to perform the second mode in a case where the sheet size information specified by the job is the B5 size and the sheet length detection unit outputs the output value corresponding to a length of the B5 size in the sheet conveyance direction.

* * * * *